US008373537B2

(12) United States Patent
Park et al.

(10) Patent No.: US 8,373,537 B2
(45) Date of Patent: Feb. 12, 2013

(54) RESISTOR HAVING PARALLEL STRUCTURE AND METHOD OF FABRICATING THE SAME

(75) Inventors: Mi Jin Park, Gyunggi-do (KR); Young Do Kweon, Seoul (KR); Jin Gu Kim, Gyunggi-do (KR)

(73) Assignee: Samsung Electro-Mechanics Co., Ltd., Suwon (KR)

( * ) Notice: Subject to any disclaimer, the term of this patent is extended or adjusted under 35 U.S.C. 154(b) by 205 days.

(21) Appl. No.: 12/923,574

(22) Filed: Sep. 28, 2010

(65) Prior Publication Data

US 2011/0273266 A1 Nov. 10, 2011

(30) Foreign Application Priority Data

May 6, 2010 (KR) ..... 10-2010-0042604

(51) Int. Cl.
*H01C 1/012* (2006.01)

(52) U.S. Cl. ..... 338/314; 338/315; 338/333; 29/610.1

(58) Field of Classification Search ..... 338/314, 338/204, 310, 115, 312, 332
See application file for complete search history.

(56) References Cited

U.S. PATENT DOCUMENTS 4,179,797 A * 12/1979 Johnson ..... 29/610.1
4,300,115 A * 11/1981 Ansell et al. ..... 338/314
5,164,699 A * 11/1992 Smith et al. ..... 338/310
6,100,787 A * 8/2000 Huang et al. ..... 338/204
6,329,065 B1 * 12/2001 Ishida et al. ..... 428/472
2004/0163234 A1 * 8/2004 Provo et al. ..... 29/620
2009/0322466 A1 12/2009 McGuinness et al.

FOREIGN PATENT DOCUMENTS

| | | |
|---|---|---|
| JP | 11-16703 | 1/1999 |
| JP | 10-0568515 | 3/2006 |
| JP | 2006-73729 | 3/2006 |
| KR | 2000-0003630 | 1/2000 |

OTHER PUBLICATIONS

Korean Office Action issued Jun. 27, 2011 in corresponding Korean Patent Application 10-2010-0042604.

* cited by examiner

*Primary Examiner* — Kyung Lee

(57) ABSTRACT

There are provided a resistor and a method of fabricating the same. The resistor includes: a substrate; a lower resistant material layer formed on the upper portion of the substrate; an insulating layer to be stacked on the upper portion of the lower resistant material layer; an upper resistant material layer to be stacked on the upper portion of the insulating layer; and two penetration parts vertically penetrating through the insulating layer, wherein the penetration part is filled with a resistant material having the same component as that of the lower resistant material layer and the upper resistant material layer to electrically connect the upper resistant material layer to the lower resistant material layer.

17 Claims, 5 Drawing Sheets

RESISTOR HAVING PARALLEL STRUCTURE AND METHOD OF FABRICATING THE SAME

CROSS-REFERENCE TO RELATED APPLICATIONS

This application claims the priority of Korean Patent Application No. 2010-0042604 filed on May 6, 2010, in the Korean Intellectual Property Office, the disclosure of which is incorporated herein by reference.

BACKGROUND OF THE INVENTION

1. Field of the Invention

The present invention relates to a resistor and a method of fabricating the same, and more particularly, to a resistor having a parallel structure capable of easily implementing a resistance value when forming a resistor directly on a wafer during a wafer process, and a method of fabricating the same.

2. Description of the Related Art

In general, a chip resistor used in electronic components is commonly divided into a thick film type chip resistor and a thin film type chip resistor according to the thickness of a resistor. Among others, the thin film chip resistor has an excellent temperature coefficient of resistance that is one of the most important characteristics of the resistor as compared to the thick film chip resistor, to be suitable for implementing precision resistance. As a result, the demand for the thin film chip resistor has been gradually increasing in compact precision digital equipment such as MP3 players, camcorders, digital cameras and the like.

The thin film chip resistor according to the prior art uses a thin film resistance material formed by allowing a material such as NiCr or the like to be subject to a thin film process such as a sputtering process or a deposition process. A general thin film chip resistor is configured to include a resistant material formed on an upper surface of an insulating substrate and a '⊏' shaped side terminal unit connected to the resistant material and formed on both cross-sections. The thin film chip resistor may have various other structures.

In the thin film chip resistor according to the prior art, the resistant material is generally formed of a single layer and a resistance value is controlled by controlling the size of the resistant material or performing laser trimming. Therefore, when the resistor is fabricated to have a micro size, the resistance value of the resistor is not easily controlled with a known method.

SUMMARY OF THE INVENTION

An aspect of the present invention provides a resistor having a parallel structure capable of easily implementing a target resistance value even in a micro sized resistor, and a method of fabricating the same.

According to an aspect of the present invention, there is provided a resistor, including: a substrate; a lower resistant material layer formed on the upper portion of the substrate; an insulating layer to be stacked on the upper portion of the lower resistant material layer; an upper resistant material layer to be stacked on the upper portion of the insulating layer; and two penetration parts vertically penetrating through the insulating layer, wherein the penetration part is filled with a resistant material having the same component as that of the lower resistant material layer and the upper resistant material layer to electrically connect the upper resistant material layer to the lower resistant material layer.

At least one intermediate resistant material layer may be interposed between the lower resistant material layer and the upper resistant material layer.

The resistor may further include two terminal electrodes formed on the upper portion of the upper resistant material layer and spaced apart from each other.

The terminal electrodes may be formed on the positions corresponding to the penetration parts, respectively.

The terminal electrode may be plated with a conductive metal of a different material than that of the resistant material.

The resistor may further include an insulating protective layer formed on the upper resistant material layer and protecting the upper resistant material layer from the outside.

The resistor may further include a metal protective layer plated with a conductive metal of a different material than that of the resistant material and formed on the upper surface of the upper resistant material layer.

The lower resistant material layer and the upper resistant material layer may have the same size.

According to another aspect of the present invention, there is provided a resistor, including: two or more resistant material layers spaced apart from each other in parallel; an insulating layer interposed between the resistant material layers; and at least two conductive vias vertically penetrating through the insulating layer and electrically connecting the resistant material layers.

The conductive via may be formed of a resistant material having the same component as that of the resistant material layers.

The resistor may further include a substrate attached to the external surface of any one of the resistant material layers.

The resistor may further include two terminal electrodes formed on the external surface of any one of the resistant material layers and spaced apart from each other.

According to another aspect of the present invention, there is provide a method of fabricating a resistor, including: forming a lower resistant material layer on a substrate; forming an insulating layer on the lower resistant material layer; forming two or more conductive vias on the insulating layer; and forming an upper resistant material layer on the insulating layer, wherein the conductive via electrically connects the lower resistant material layer to the upper resistant material layer.

The method of fabricating a resistor further includes forming terminal electrodes spaced apart from each other on the upper resistant material layer.

The forming of the terminal electrodes may include: forming an insulating protective layer on the upper resistant material layer; removing a portion on which the terminal electrode is formed from the insulating protective layer; and forming a metal layer on the removed portion.

The method of fabricating a resistor may further include after forming of the upper resistant material layer, additionally stacking an insulating layer and a resistant material layer to be alternated with each other on the upper resistant material layer.

The substrate may be a wafer, and the upper resistant material layer and the lower resistant material layer may include a plurality of resistance patterns, respectively.

The method of fabricating a resistor may further include after the forming of the terminal electrodes, cutting the wafer into a plurality of separate resistors according to the resistance pattern.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE PREFERRED EMBODIMENT

Figure 1:
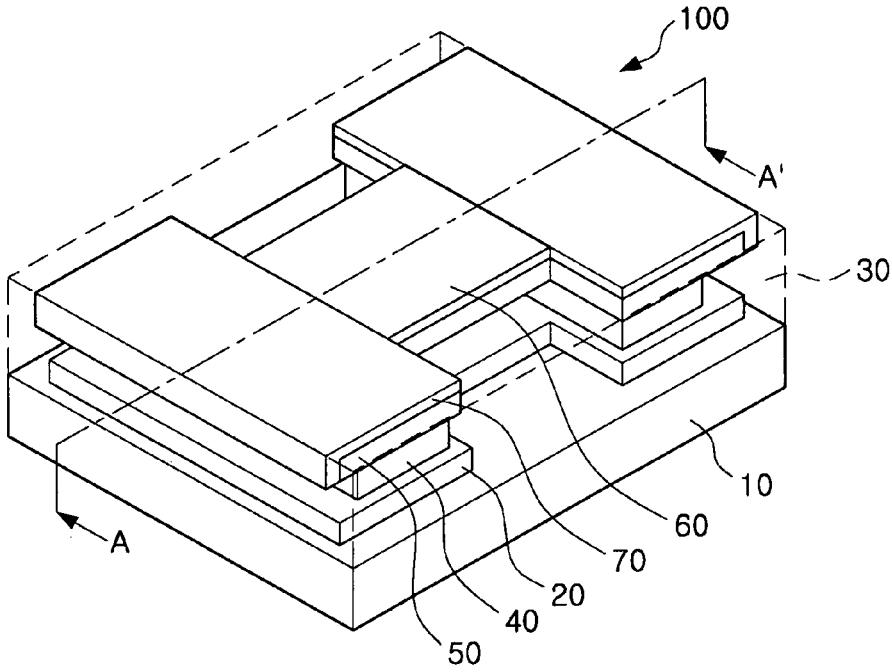
FIG. 1 is a perspective view showing a resistor having a parallel structure according to an exemplary embodiment of the present invention.

The terms and words used in the present specification and claims should not be interpreted as being limited to typical meanings or dictionary definitions, but should be interpreted as having meanings and concepts relevant to the technical scope of the present invention based on the rule according to which an inventor can appropriately define the concept of the term to describe most appropriately the best method he or she knows for carrying out the invention. Therefore, the configurations described in the embodiments and drawings of the present invention are merely most preferable embodiments but do not represent all of the technical spirit of the present invention. Thus, the present invention should be construed as including all the changes, equivalents, and substitutions included in the spirit and scope of the present invention at the time of filing this application.

Hereinafter, exemplary embodiments of the present invention will be described in detail with reference to the accompanying drawings. At this time, it is noted that like reference numerals denote like elements in appreciating the drawings. Moreover, detailed descriptions related to well-known functions or configurations will be ruled out in order not to unnecessarily obscure the subject matter of the present invention. Based on the same reason, it is to be noted that some components shown in the drawings are exaggerated, omitted or schematically illustrated, and the size of each component does not exactly reflect its real size.

Hereinafter, embodiments of the present invention will be described in detail with reference to the accompanying drawings.

Figure 2:
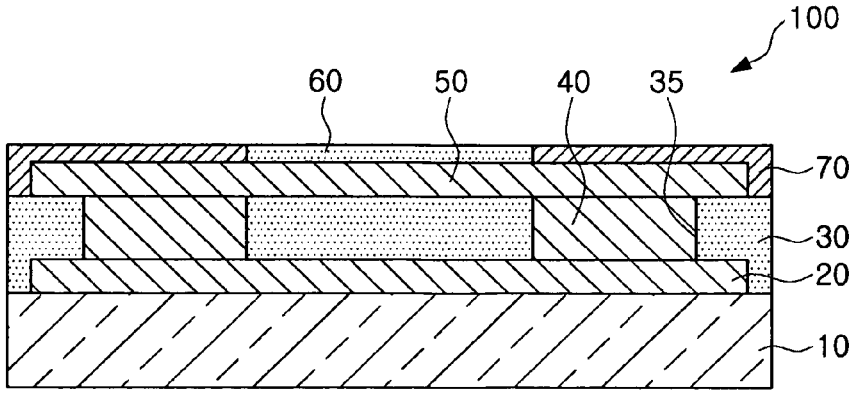
FIG. 2 is a cross-sectional view taken along line A-A' of FIG. 1.

FIG. 1 is a perspective view showing a resistor having a parallel structure according to an exemplary embodiment of the present invention, and FIG. 2 is a cross-sectional view taken along line A-A' of FIG. 1. In this case, FIG. 1 shows an insulating layer 30 of FIG. 2 three-dimensionally so as to clearly understand the internal structure thereof.

Referring to FIG. 1, a resistor 100 having a parallel structure according to the present invention is configured to include a substrate 10, a lower resistant material layer 20, an insulating layer 30, an upper resistant material layer 50, a terminal electrode 70, and an insulating protective layer 60.

The substrate 10, which is a semiconductor wafer substrate, may be a silicon substrate.

The lower resistant material layer 20 is formed on the substrate 10. The lower resistant material layer 20 may be formed of a metal layer (hereinafter, referred to as "resistant material") of a general resistant component and be formed to have various patterns.

The insulating layer 30 is stacked on the upper portion of the lower resistant material layer 20 and has a penetration part 35 formed therein, the penetration part 35 vertically penetrating through the insulating layer 30. According to the present embodiment, two penetration parts 35 are formed and they are spaced apart from each other at a predetermined interval. The inside of the penetration part 35 is filled with resistant material having the same component as that of the lower resistant material layer 20 to form a conductive via 40. The conductive via 40 electrically connects the lower resistant material layer 20 to the upper resistant material layer 50 to be described below. The via 40 may be formed to have a cylindrical shape and may be made to have various shapes corresponding to the pattern shapes of the lower resistant material layer 20 and the upper resistant material layer 50.

The upper resistant material layer 50 is formed on the upper surface of the insulating layer 30. The upper resistant material layer 50 may be formed of a resistant material having the same component as that of the lower resistant material layer 20 and have the same size and pattern as the lower resistant material layer 20. Therefore, the lower resistant material layer 20 and the upper resistant material layer 50 have the shape as if the same patterns overlap with each other, as shown in FIG. 1. As described above, the upper resistant material layer 50 is electrically connected to the lower resistant layer 20 through the via 40.

The terminal electrode 70 is formed on the upper surface of the upper resistant material layer 50. Two terminal electrodes 70 are formed and they are spaced apart from each other at a predetermined interval. Referring to the figures, the terminal electrodes 70 according to the present embodiment are each formed on distal ends at both sides of the upper resistant material layer 50, each corresponding to the penetration parts 35. The terminal electrodes 70, however, are not limited thereto but may be variously disposed if they can electrically connect the resistor 100 to the outside, while having a parallel structure.

The terminal electrode 70 according to the present embodiment is made of a conductive metal of a different material than that of the resistant material. For example, nickel, platinum or the like may used for the terminal electrode 70. Metal having the same component as that of the resistant material may also be used, as needed.

The insulating protective layer 60 is formed between the terminal electrodes 70 on the upper resistant material layer 50. More specifically, the insulating protective layer 60 is formed over the upper resistant material layer 50 and the upper surface of the insulating layer 30, except for the portion in which the terminal electrodes 70 are formed, and protects the upper resistant material layer 50 from the outside.

The resistor 100 according to the present embodiment as constituted above has a parallel structure. In other words, the resistor 100 according to the present embodiment is configured to have a shape in which the insulating layer 30 is interposed between the upper resistant material layer 50 and the lower resistant material layer 20 spaced apart from each other in parallel and have a structure in which the via 40 vertically penetrating through the insulating layer 30 electrically connects the upper resistant material layer 50 to the lower resistant material layer 20.

Therefore, in the resistor 100 according to the present invention, two distinguished electrical paths are formed: a path formed by the upper resistant material layer 50 and a path formed by the via 40 and the lower resistant material layer 20. Therefore, a circuit connecting two resistors 100 in parallel is configured even though one resistor 100 is used, thereby making it possible to easily control a resistance value even through the resistant material layers 20 and 60 are not formed to have smaller patterns.

Next, a method of fabricating a resistor having a parallel structure according to the present invention will be described.

Figure 3A:
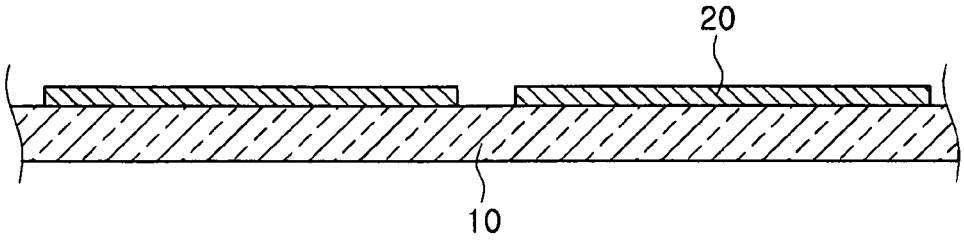
FIGS. 3A to 3G are cross-sectional views for explaining a method of fabricating a resistor having a parallel structure according to the present invention.
Figure 3B:
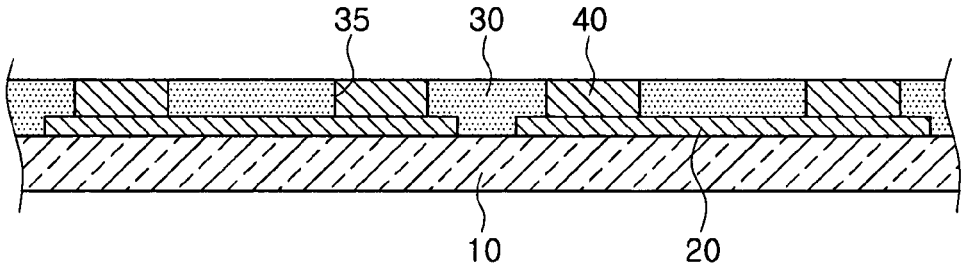
Figure 3C:
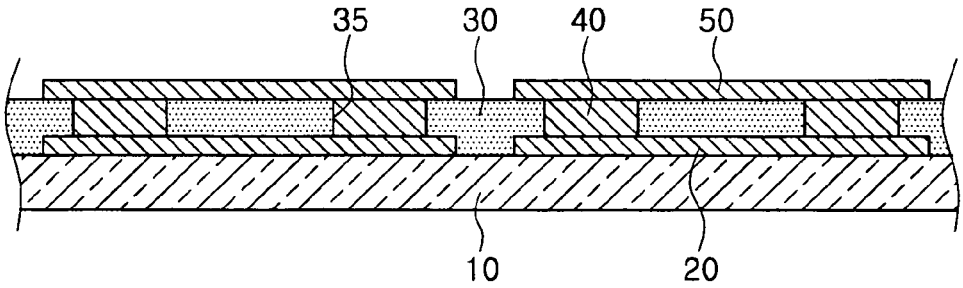
Figure 3D:
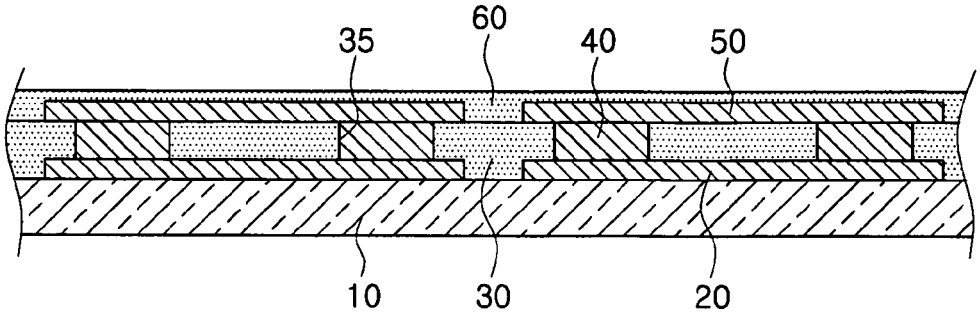
Figure 3E:
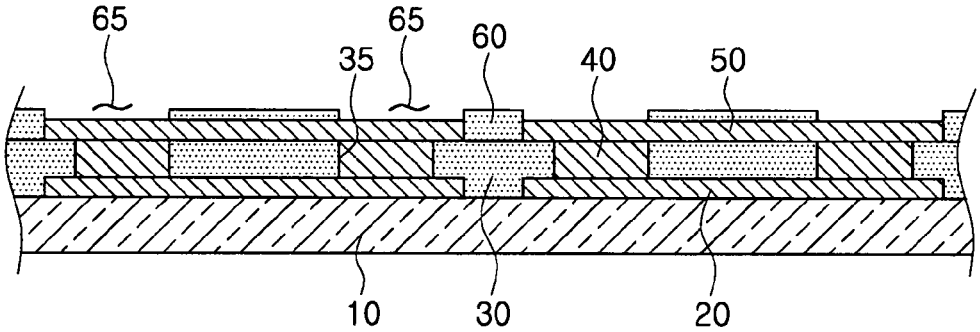
Figure 3F:
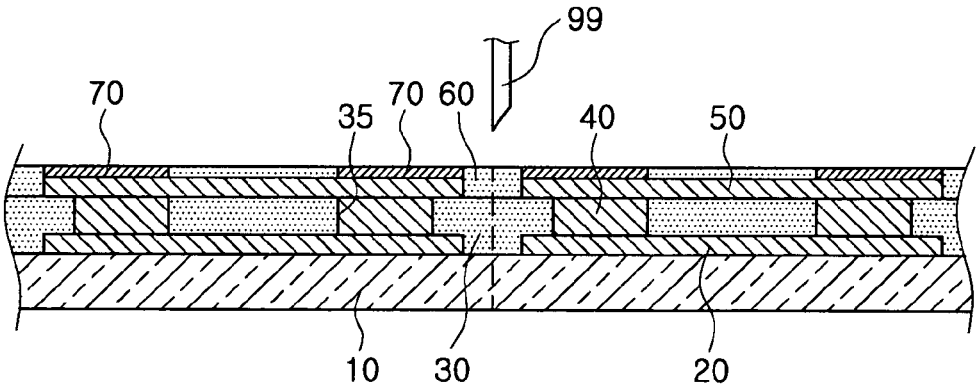
Figure 3G:
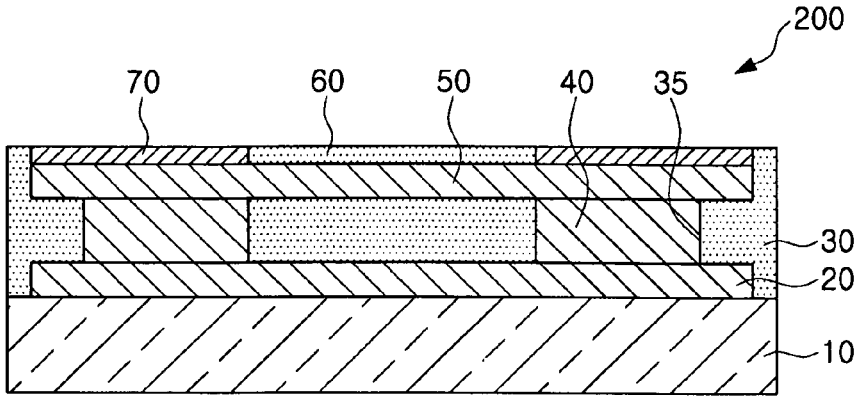
Figure 4:
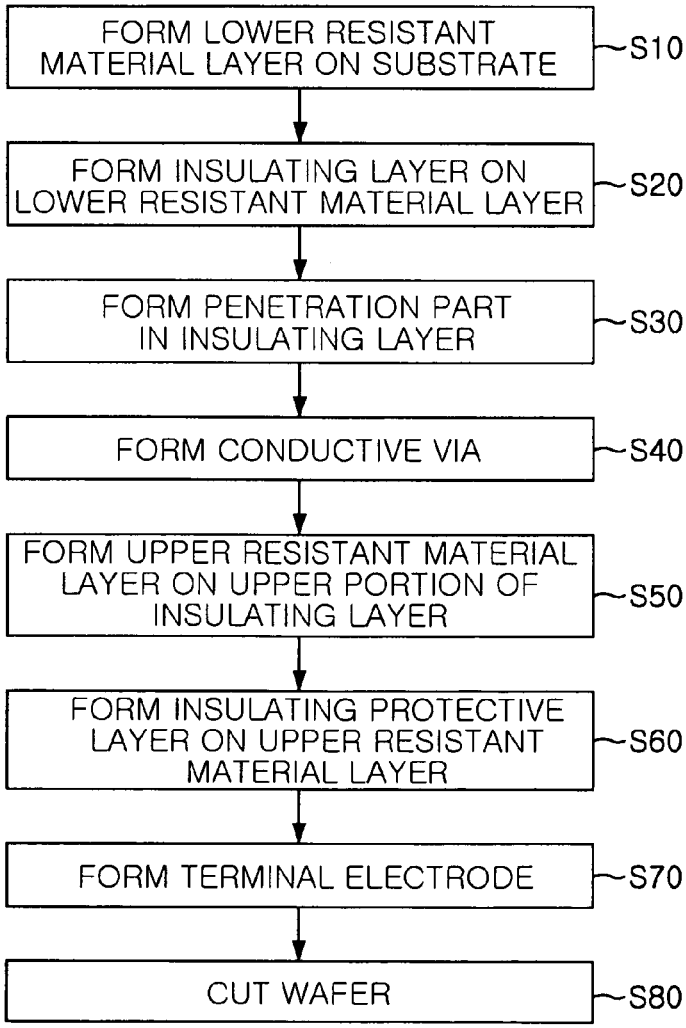
FIG. 4 is a flow chart for explaining a method of fabricating a resistor having a parallel structure according to the present invention.

FIGS. 3A to 3G are cross-sectional views for explaining a method of fabricating a resistor having a parallel structure according to the present invention, FIG. 4 is a flow chart for explaining a method of fabricating a resistor having a parallel structure according to the present invention.

Referring to the figures, first, the lower resistant material layer 20 is formed on the substrate 10 in a wafer state as shown in FIG. 3A (S10). More specifically, the resistant material layer is first formed by applying the resistant material onto the substrate 10 using a sputtering method or the like and then, the applied resistant material layer is formed to have a desired pattern through a photolithography process. Thereby, the lower resistant material layer 20 having a pattern is formed on the substrate 10. In this case, the lower resistant material layer 20 may have a plurality of patterns having the same shape or a plurality of patterns having various shapes. The pattern of the lower resistant material layer 20 according to the present embodiment is formed as the patterns having the same shape are each electrically separated through the photolithography process, wherein each separate pattern is formed to have an 'H' shape as shown in FIG. 1. However, the pattern of the lower resistant material layer 20 is not limited thereto but may be formed to have various shapes.

Next, the insulating layer 30 is formed on the lower resistant material layer 20 of which patterns are formed (S20). The insulating layer 30 may be a silicon oxide film. The insulating layer 30 is applied onto the lower resistant material layer 20 so as to cover the entire wafer including the lower resistant material layer 20.

After the insulating layer 30 is formed, the penetration part 35 is formed in the insulating layer 30 (S30). As described above, the resistors 100 (in FIG. 2) and 200 (in FIG. 3G) according to the present invention have a parallel structure. The penetration part 35 electrically connects each of the resistant material layers 20 and 50, thereby completing a parallel structure. Therefore, two penetration parts 35 according to the present invention are formed for each separate pattern, wherein the two penetration parts 35 are formed to be spaced apart from each other as far as possible in one separate pattern.

After the penetration part 35 is formed, the inside of the penetration part 35 is filled with a resistant material to form the conductive via 40 as shown in FIG. 3B (S40). In this case, the resistant material filled inside the penetration part 35 is a resistant material having the same component as that of the lower resistant material layer 20 and the upper resistant material layer 50. Therethrough the lower resistant material layer 20 is electrically connected to the resistant material (hereinafter, referred to as a "via") filling the penetration part 35.

Next, the upper resistant material layer 50 is formed on the upper portion of the insulating layer 30 in which the via 40 is formed as shown in FIG. 3C (S50). The process of forming the upper resistant material layer 50 is performed, similar to the process of forming the lower resistant material layer 20. In other words, after the resistant material layer is formed by applying a resistant material onto the insulating layer 30, the applied resistant material layer is formed to have a desired pattern through a photolithography process or the like, thereby forming the upper resistant material layer 50. In this case, the upper resistant material layer 50 is formed to have the same pattern and size as the lower resistant material layer 20. The upper resistant material layer 50 is electrically connected to the via 40, and the upper resistant material layer 50 and the lower resistant material layer 20 form a parallel structure through the via 40.

Meanwhile, the present embodiment describes the case in which only two vias 40 are formed in one resistor 200 by way or example but the present invention is not limited thereto. If a parallel structure can be maintained by forming each via into groups of vias that are formed of a plurality of vias 40, or the like, various modifications can be made.

Next, the insulating protective layer 60 is formed on the upper resistant material layer 50 as shown in FIG. 3D (S60). This is to protect the upper surface of the upper resistant material layer 50 from being broken due to external force. The insulating protective layer 60 may be omitted, as needed.

After the insulating protective layer 60 is formed, the terminal electrode 70 is formed (S70). The terminal electrode 70 according to the present embodiment is electrically connected to the upper resistant material layer 50. Therefore, a process of removing a portion of the insulating protective layer 50 corresponding to the position 65 on which the terminal electrode 70 is formed is first performed as shown in FIG. 3E.

When the portion of the insulating protective layer 60 is removed, the terminal electrode 70 formed of a metal layer is formed in the removed space 65. The terminal electrode 70 may be formed by plating the corresponding position 65 with a conductive metal. In this case, it is preferable that the conductive metal be metal having high electrical conductivity and dissimilar to the resistant material. The conductive metal may use nickel, platinum or the like.

Meanwhile, a plurality of resistors 200 according to the present invention may be formed on one wafer as described above. Therefore, a process of cutting a wafer should be performed so that the resistors 200 are each finally separated. Therefore, when the step of forming the terminal electrode 70 (S70) is completed, the wafer is cut, using a cutting blade 99, into a plurality of separate resistors 200 according to the resistance patterns (S80), as shown in FIG. 3F. Therefore, the resistor 200 according to the present embodiment is finally completed, as shown in FIG. 3G.

The resistor having a parallel structure and the method of fabricating the same according to the present invention as described above are not limited to the aforementioned embodiment but various applications can be made.

For example, in the case of the terminal electrode 70 according to the present invention, it may be positioned in various positions with various shapes. As a specific example, the resistor 200 shown in FIG. 3G shows the case in which the electrode terminal 70 is formed on only the upper surface of the upper resistant material layer 50. It is not limited thereto; however, the electrode terminal 70 may also be formed to cover even up to the side surface of the upper resistant material layer 50 as shown in the resistor 100 of FIG. 2. In the case of the resistor 100 of FIG. 2, the electrode terminal 70 may be selectively formed by controlling the range in which the insulating protective layer 60 is removed.

Other applications can be made and these will be described with reference to FIGS. 5A to 5C.

Figure 5A:
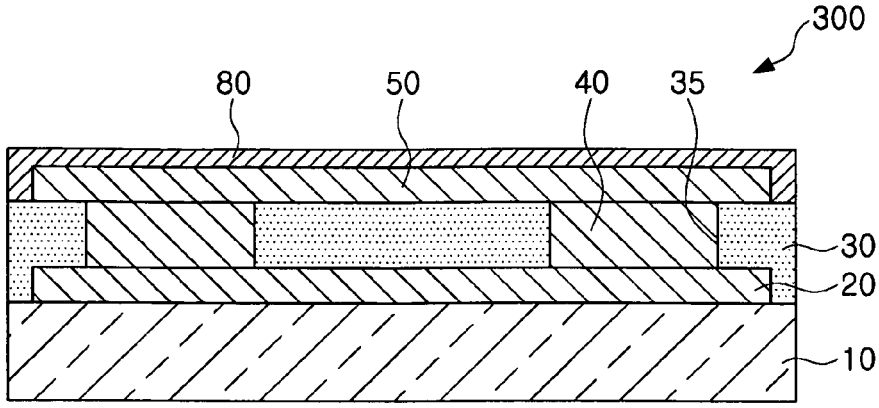
FIGS. 5A to 5C are cross-sectional views showing another embodiments according to the present invention.
Figure 5B:
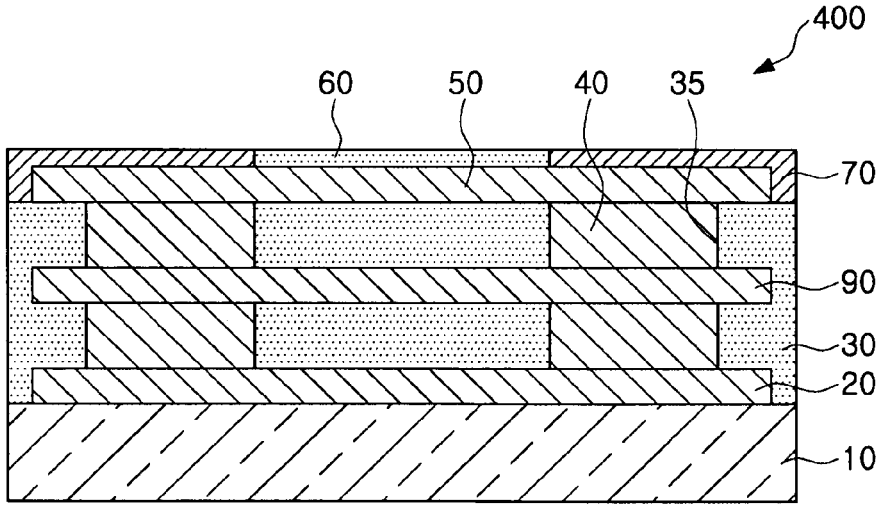
Figure 5C:
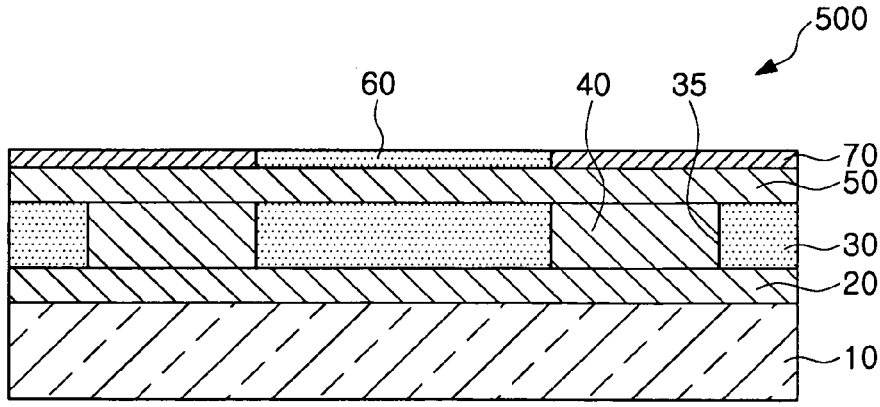

FIGS. 5A through 5C show other embodiments according to the present invention. First, FIG. 5A shows a resistor 300 in which the insulating protective layer 60 is not formed on the upper resistant material layer 50 but a metal protective layer 80 is formed by plating the entire upper surface of the upper resistant material layer 50 with a conductive metal. In this case, the metal protective layer 80 uses metal having high electrical conductivity rather than the aforementioned resistant material. The metal protective layer 80 may use nickel, platinum or the like used in the terminal electrode 70.

FIG. 5B shows a resistor 400 in which an intermediate resistant material layer 90 is interposed between the upper resistant material layer 50 and the lower resistant material layer 20. Herein, the intermediate resistant material layer 90 have the same component and size as the upper resistant material layer 50 and the lower resistant material layer 20. As described above, the resistor 400 according to the present invention is not limited to have two resistant material layers 20 and 50. Although FIG. 5B shows a case in which the resistance value of the resistor 400 is controlled by stacking a total of three resistant material layers 20, 50 and 90, the present invention is not limited thereto but may additionally include a resistant material layer, as needed. Meanwhile, in order to configure the resistor 400 with three or more resistant material layers as described above, after performing the step of forming the upper resistant material layer 50 (S50), the step of forming the insulating layer 30 (S20) and the step of forming the upper resistant material layer 50 (S50) are repeatedly performed, thereby making it possible to form an additional resistant material layer.

In the case of a resistor 500 shown in FIG. 5C, the upper resistant material layer 50 and the lower resistant material layer 20 are formed at both side surfaces of the resistor 500 to be exposed. This may be formed by performing each fabricating step in a state in which each separate pattern is not completely separated but is partially or entirely connected during a process of forming the patterns of the lower resistant material layer 20 and the upper resistant material layer 50 and cutting the insulating layer 30 and the resistant material layers 20 and 50 at the final wafer cutting step (S80).

As described above, the resistor according to the present invention has a parallel structure formed of a plurality of layers to control the number and size or the like of the paths connected in parallel, thereby making it possible to easily control the resistance value of the resistor. Therefore, the resistor can be easily formed during the wafer process and the micro size resistor can be effectively fabricated.

In addition, in the case of the resistor having a parallel structure according to the present invention, the plurality of resistant material layers are used, thereby making it possible to reduce resistor distribution. In addition, a precision resistor having low resistance (50 mΩ or less) capable of using high current (0.25 mA or more) can be easily fabricated.

Meanwhile, the embodiments of the present invention disclosed in the specification and the drawings merely describe specific examples in order to easily explain the technical contents of the present invention and help in a thorough and complete understanding of the present invention and do not intend to limit the scope of the present invention. It is apparent to those skilled in the art that various modified embodiments based on the technical spirit of the present invention can be carried out, in addition to the embodiments disclosed herein.

For example, the aforementioned embodiment describes the case in which the micro size resistor is formed on the wafer by way of example, any substrates other than the wafer capable of forming a parallel structure, such as a PCB substrate or the like, may be variously used and resistors having various sizes other than the micro size may also be used.

In addition, the aforementioned embodiment describes the case in which the substrate is configured to support the lower surface of the resistor but it is not limited thereto. In other words, the entirety or the portion of the substrate may be removed and the terminal electrode may also be formed on the position from which the substrate is removed.

As described above, the resistor having a parallel structure according to the present invention can be fabricated in various structures and various methods. If the parallel structure of the resistor can be maintained, various applications can be made in the fabrication method and structure.

As set forth above, with the resistor having a parallel structure and a method of fabricating the same according to the present invention, the resistor has a parallel structure formed of a plurality of layers to control the number and size or the like of the paths connected in parallel, thereby making it possible to easily control the resistance value of the resistor. Therefore, the resistor can be easily formed during the wafer process and the micro size resistor can be effectively fabricated.

In addition, in the case of the resistor having a parallel structure according to the present invention, the plurality of resistant material layers are used, thereby making it possible to reduce resistor distribution. In addition, a precision resistor having low resistance (50 mΩ or less) capable of using high current (0.25 mA or more) can be easily fabricated.

While the present invention has been shown and described in connection with the exemplary embodiments, it will be apparent to those skilled in the art that modifications and variations can be made without departing from the spirit and scope of the invention as defined by the appended claims.

What is claimed is:

1. A resistor fabricated during a wafer process, comprising:
a substrate;
a lower resistant material layer formed on the upper portion of the substrate;
an insulating layer to be stacked on the upper portion of the lower resistant material layer;
an upper resistant material layer to be stacked on the upper portion of the insulating layer; and
two penetration parts, vertically penetrating through the insulating layer, filled with a resistant material having the same component as that of the lower resistant material layer and the upper resistant material layer to electrically connect the upper resistant material layer to the lower resistant material layer.

2. The resistor of claim 1, wherein at least one intermediate resistant material layer is interposed between the lower resistant material layer and the upper resistant material layer.

3. The resistor of claim 1, further comprising two terminal electrodes formed on the upper portion of the upper resistant material layer and spaced apart from each other.

4. The resistor of claim 3, wherein the terminal electrodes are formed on the positions corresponding to the penetration parts, respectively.

5. The resistor of claim 3, wherein the terminal electrode is plated with a conductive metal of a different material than that of the resistant material.

6. The resistor of claim 3, further comprising an insulating protective layer formed on the upper resistant material layer and protecting the upper resistant material layer from the outside.

7. The resistor of claim 1, further comprising a metal protective layer plated with a conductive metal of a different material than that of the resistant material and formed on the upper surface of the upper resistant material layer.

8. The resistor of claim 1, wherein the lower resistant material layer and the upper resistant material layer have the same size.

9. A resistor fabricated during a wafer process, comprising:
two or more resistant material layers spaced apart from each other in parallel;

an insulating layer interposed between the resistant material layers; and at least two conductive vias vertically penetrating through the insulating layer and electrically connecting the resistant material layers, the conductive vias formed of a resistant material having the same component as that of the resistant material layers.

10. The resistor of claim 9, further comprising a substrate attached to the external surface of any one of the resistant material layers.

11. The resistor of claim 9, further comprising two terminal electrodes formed on the external surface of any one of the resistant material layers and spaced apart from each other.

12. A method of fabricating a resistor during wafer process, comprising:

forming a lower resistant material layer on a substrate;

forming an insulating layer on the lower resistant material layer;

forming two or more conductive vias on the insulating layer; and forming an upper resistant material layer on the insulating layer, the conductive vias electrically connecting the lower resistant material layer to the upper resistant material layer, and the conductive vias being formed of a resistant material having the same component as that of the resistant material layers.

13. The method of fabricating a resistor of claim 12, further comprising forming terminal electrodes spaced apart from each other on the upper resistant material layer.

14. The method of fabricating a resistor of claim 13, wherein the forming of the terminal electrodes includes:

forming an insulating protective layer on the upper resistant material layer;

removing a portion on which the terminal electrode is formed from the insulating protective layer; and forming a metal layer on the removed portion.

15. The method of fabricating a resistor of claim 12, further comprising after forming of the upper resistant material layer, additionally stacking an insulating layer and a resistant material layer to be alternated with each other on the upper resistant material layer.

16. The method of fabricating a resistor of claim 13, wherein the substrate is a wafer, and the upper resistant material layer and the lower resistant material layer include a plurality of resistance patterns, respectively.

17. The method of fabricating a resistor of claim 16, further comprising after the forming of the terminal electrodes, cutting the wafer into a plurality of separate resistors according to the resistance pattern.

* * * * *